United States Patent [19]

Durso

[11] Patent Number: 5,035,433

[45] Date of Patent: Jul. 30, 1991

[54] GOLF SWING TRAINING MAT

[76] Inventor: Joseph M. Durso, 1404 Crowell Rd., Vienna, Va. 22182

[21] Appl. No.: 533,313

[22] Filed: Jul. 17, 1990

Related U.S. Application Data

[63] Continuation-in-part of Ser. No. 542,774, Jun. 25, 1990.

[51] Int. Cl.[5] ..... A63B 69/36

[52] U.S. Cl. ..... 273/187 A; 273/195 A

[58] Field of Search ..... 273/187 R, 187 A, 187 B, 273/183 A, 195 R, 195 A

[56] References Cited

U.S. PATENT DOCUMENTS 2,707,638 5/1955 Manley ..... 273/187 A 4,113,258 9/1978 Midana ..... 273/187 A

*Primary Examiner*—George J. Marlo

*Attorney, Agent, or Firm*—Christopher John Rudy

[57] ABSTRACT

A golf swing training mat has a follow-through notch. Golfers may align their feet and body with the notched mat and hit the ball near a hitting area edge thereof for more authentic golf swing training, especially at driving ranges. The mat has a hitting surface made of a material that nearly looks and gives a feeling of real grass and that is not easily destroyed by repeated swings of a golf club striking the material, and also a soft underpad. The golfer is able and is encouraged to realistically practice hitting down and through a golf ball as is to be done with an iron shot to obtain good backspin and hence, loft. Bounce-back or shock can be generally eliminated. Thus, the golfer can practice a fluid iron stroke generally without mat-caused interruption. In addition, the follow-through notch, is in part defined by a hitting area edge segment perpendicular to an intended line of flight of the golf ball to be struck by the golfer from the hitting surface, and is trapezoidal and additionally defined by an obliquely-angled edge segment obliquely angled to the abutting the hitting area edge segment, which envoids an area such that the golfer, when swinging an iron, can properly follow through downwardly after striking a golf ball with a golf club into the downwardmost portion of the swing when the ball is struck near the edge of the mat on the hitting area, and which allows for the golfer to follow through in a practice swing without striking the obliquely-angled edge segment.

12 Claims, 1 Drawing Sheet

GOLF SWING TRAINING MAT

CROSS-REFERENCE

This is a continuation-in-part of parent U.S. Pat. application Ser. No. 07/542,774 filed on July 25, 1990. Said parent is incorporated herein by reference.

FIELD

This invention concerns a golf practice article, its preparation and use. The invention is a useful amusement.

BACKGROUND

Since at least the mid-1930's people have been trying to find a way to allow a practicing golfer to repeatedly attempt golf shots from a surface that is somewhat similar to natural turf yet is not destroyed with each strike of the club at the ball. Materials have evolved from wire or bristle brush mats to polyurethane or nylon materials that nearly look and give more of the same feeling as real grass, yet are not easily destroyed with each strike of the ball. With thick soft underpad cushioning each strike, and a comfortable 5×5 feet square shape, it might be concluded that the ultimate has been reached.

However, one more major improvement otherwise remains needed in such mats, noting better golfers prefer not to hit practice balls off these modern golf mats, which are popular with beginners. The reason the better golfers disdain using these modern golf mats is that bounce-back or shock is felt primarily in the forward hand when the ball would be properly struck down and through, say, with an iron. As a result, off such known mats, a golfer, regardless of skill, cannot learn or experience the feeling of a well-struck iron shot having had the proper backspin imparted to the ball.

In addition, lining up properly is essential to a consistently good golf swing. A square golf mat offers no really effective guide to proper foot and club placement at the address position.

Moreover, golf driving range operators in general are not in much of a position to give golf swing instruction, especially with the great numbers of hitting positions having such known mats implaced on the range. Accordingly, beginning golfers, without an opportunity for instruction at such a range, usually develop bad golf swing habits on the range, which carry over onto the actual course.

SUMMARY

The present invention, in one aspect, provides a golf swing training mat having a follow-through notch. Another aspect comprises hitting a ball off near an edge of the mat.

The invention is a useful amusement.

This invention overcomes aforementioned problems in the art. With the mat of the present invention, a golfer is able and is encouraged to realistically practice hitting down and through the ball as is to be done with an iron shot to obtain good backspin and hence, loft. Bounce-back or shock can be generally eliminated, and the golfer can thus practice a fluid iron stroke generally without mat-caused interruption. A really effective guide to proper foot and club placement at the address position can be obtained. Accordingly, golfers, even at driving ranges where mats of the present invention are emplaced, can develop better golf swing habits during practice, which carry over onto the actual course. Beginning as well as experienced golfers can find this invention advantageous as truly authentic and proper golf swings can be practiced therewith.

Further advantages attend the present invention.

DRAWINGS

The drawings form part of the specification hereof.

ILLUSTRATIVE DETAIL

Figure 1:
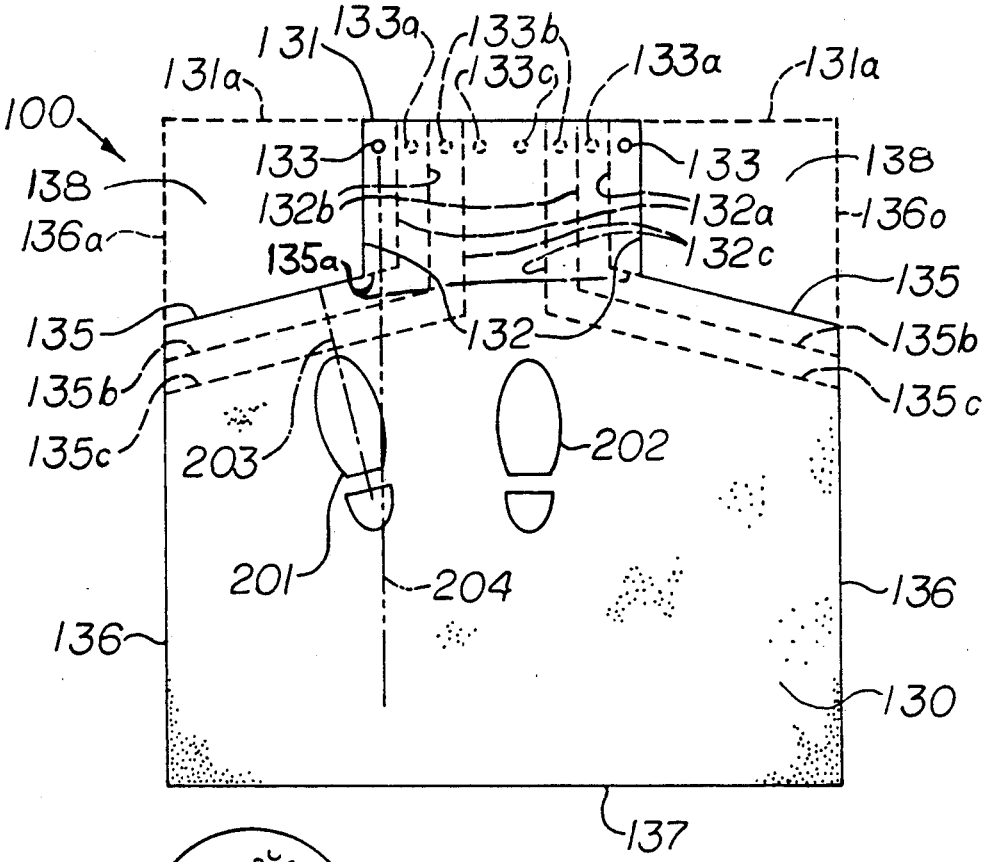
FIG. 1 is a top plan view of a mat of this invention.
Figure 3:
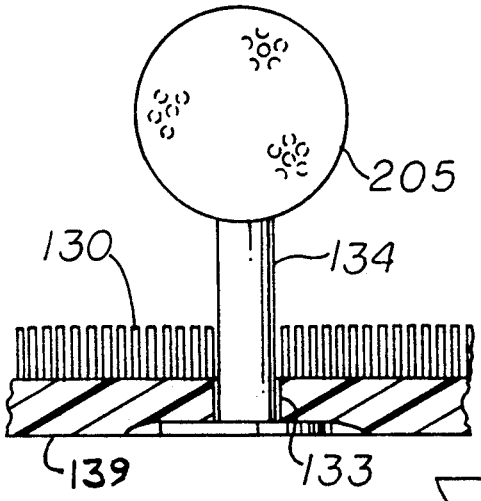
FIG. 3 is a perspective view of a mat of the present invention such as shown in FIGS. 1 & 2 in use.
Figure 2:
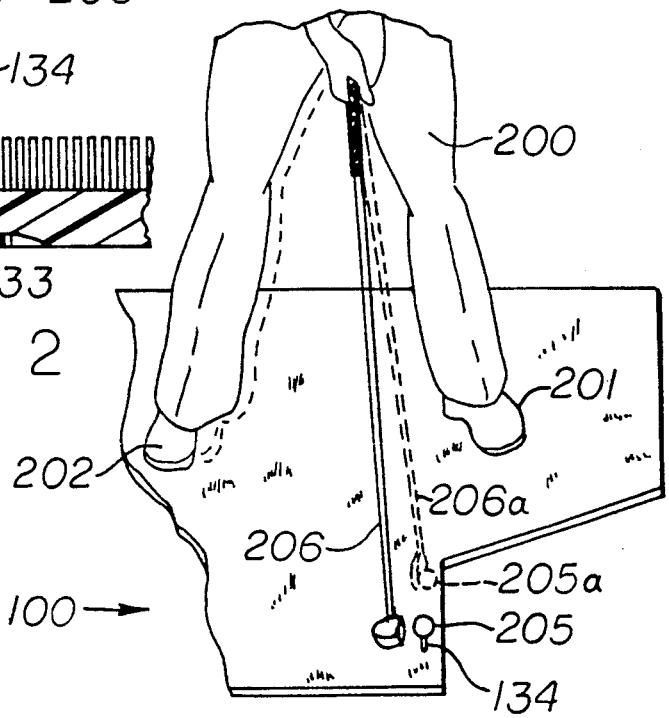
FIG. 2 is a cutaway side view of part of the mat shown in FIG. 1.

In general, the golf swing training mat of this invention has at least one follow-through notch. This notch envoids an area such that the golfer, when swinging an iron, can properly follow through downwardly after striking the ball into the downwardmost portion of the swing when the ball is struck near the edge of the mat on a hitting area thereabout. The notch may be squarely or otherwise shaped, but it is preferably made to be trapezoidal, with a hitting edge segment about from 1 to 2 feet (ca. 30.5 to 61 cm) in length perpendicular to the intended line of flight of the golf ball to be struck and another edge segment about from 1 to 2½ feet (ca. 30.5 to 72.2 cm) in length obliquely angled to the hitting area edge segment, which allows for the golfer to follow through in a practice swing without striking the obliquely-angled edge segment.

The mat of this invention may be made by known methods or processes with known materials. One method to make the mat of this invention involves simply cutting the follow-through notch with a suitable cutting instrument such as a razor knife in a commercially available 5×5 feet (1.52×1.52 meters) golfing mat. The mat is preferably of a polyurethane or nylon material that nearly looks and gives a feeling of real grass and that is not easily destroyed with repeated swings, and with thick soft underpad. For example, the mat may be made with a grass-like polyurethane or ASTRO TURF nylon hitting surface about ½-inch high with rubbery padding underlayment about 1½ inches thick.

In reference to the drawings, in which the same numerals indicate like features, and which are not necessarily drawn to scale, the following is noted.

. Golf swing training mat 100 has hitting surface 130 and two follow-through notches 138, one for right-handed golfers and the other for left-handed golfers, with the mat being turned 180 degrees to allow left-handed golfers to hit in the same general direction as right-handed golfers on the same range. Directional edge 131 generally points in the intended direction of ball flight. Hitting area edges 132, e.g., each 15 inches (38.1 cm) in length, are generally perpendicular to the intended direction of flight and are, e.g., perpendicular to the directional edge. Tee holes 133, e.g., ½-inch (1.27 cm) in diameter, are for insertion of golf tee 134, e.g., of rubber. Obliquely-angled edge segments 135, e.g., each 18 inches (45.7 cm) in length, are at an angle, e.g., about 102 degrees, from the hitting area edges. The hitting area edges and obliquely-angled edges define the notches. Additional edge segments 136 and full edge 137, e.g., 5 feet (1.52 cm) in length, are present as well. Padding 139 underlies the hitting surface.

Should the mat of the invention have been made, for example, simply by cutting out the follow-through notches from a known square golf mat, edge segments 131*a* & 136*a* would have been cut away along with that portion of the former mat that now defines the follow-through notch. In any event, after some time the mat of the invention may show some wear about the hitting areas. Then, first new hitting edge segments 132*a*, e.g., 3 inches (7.62 cm) from the original hitting edge segments, obliquely-angled edge segments 135*a*, and tee holes 133*a* may be cut to provide for further use. With further wear, second new hitting edge segments 132*b*, e.g., 3 inches (7.62 cm) from the first new hitting edge segments, obliquely-angled edge segments 135*b*, e.g., 2 inches (5.08 cm) from the original obliquely-angled edge segments, and tee holes 133*b* may be cut to provide for yet further use. With further wear, third new hitting edge segments 132*c*, e.g., 3 inches (7.62 cm) from the second new hitting edge segments, obliquely-angled edge segments 135*c*, e.g., 2 inches (5.08 cm) from the first new obliquely-angled edge segments, and tee holes 133*c* may be cut to provide for still further use.

In use, golfer 200 positions wood 206 or iron 206*a* behind teed ball 205 or unteed ball 205*a*, respectively, in the hitting area, with the club face perpendicular to the intended line of flight. Then, forward foot 201 and rearward foot 202 are lined up together perpendicular to the intended target, thus parallel to the directional edge. For example, the forward foot is lined up perpendicular to the obliquely-angled edge along imaginary forward foot line 203, and the inside part of the forward heel is placed on or slightly ahead of imaginary forward heel line 204. The golfer then takes a backswing and a forward swing, striking the ball, and if the iron is used strikes the ball and then the mat near the hitting edge segment, following through downwardly through that portion of the mat into the follow-through notch. The obliquely-angled edge segments may be used to further align the swing.

This invention is decidedly advantageous in practice.

CONCLUSION

The present invention is thus provided. Numerous adaptations and modifications can be effected by those skilled in the art within the spirit of this invention, the asserted scope of which is particularly pointed out by the following subject matter.

What is claimed is:

1. An article of manufacture comprising a golf swing training mat, having a hitting surface made of a material that nearly looks and gives a feeling of real grass and that is not easily destroyed by repeated swings of a golf club striking the material, and also having a soft underpad, such that a golfer is able and is encouraged to realistically practice hitting down and through a golf ball as is to be done with an iron shot to obtain good backspin and hence, loft, and such that bounce-back or shock can be generally eliminated, and the golfer can thus practice a fluid iron stroke generally without mat-caused interruption, and having at least one follow-through notch, in part defined by a hitting area edge segment perpendicular to an intended line of flight of the golf ball to be struck by the golfer from the hitting surface, and which is trapezoidal and is additionally defined by an obliquely-angled edge segment obliquely angled to and abutting the hitting area edge segment, which envoids an area such that the golfer, when swinging an iron, can properly follow through downwardly after striking a golf ball with a golf club into the downwardmost portion of the swing when the ball is struck near the edge of the mat on the hitting area, and which allows for the golfer to follow through in a practice swing without striking the obliquely-angled edge segment.

2. The article of claim 1, wherein the hitting surface is about ½ inch high, and the soft underpad is about 1½ inches thick.

3. The article of claim 2, wherein the obliquely-angled edge segment is obliquely angled at about 102 degrees to the hitting area edge segment.

4. The article of claim 1, which is further defined by a directional edge segment perpendicular to and abutting the hitting area edge segment away from where the obliquely-angled edge segment abuts the hitting area segment.

5. The article of claim 4, wherein the follow-through notches are two in number, one for right-handed golfers and the other for left-handed golfers.

6. The article of claim 4, which is further defined by two additional edge segments, each perpendicular to the directional edge segment but respectively abutting the obliquely-angled edge segments away from where the hitting edge segments abut the obliquely-angled edge segments, and full edge abutting the additional edge segments away from where the additional edge segments abut the obliquely-angled edge segments.

7. The article of claim 6, wherein tee holes suitable for placing rubber tees therein are present in hitting areas within three inches from the hitting area edge segments.

8. The article of claim 7, wherein the directional edge segment is parallel to and about 5 feet from the full edge, the additional edge segments are about 5 feet apart; the hitting area edge segments are about from one foot to two feet in length, and the obliquely-angled segments are about from one foot to two and one-half feet in length.

9. The article of claim 8, which has a hitting surface of a grass-like polyurethane or nylon with an underlying rubbery pad.

10. A method of useful amusement comprising providing a golf ball, a golf club, and a golf swing training mat, the mat having a hitting surface made of a material that nearly looks and gives a feeling of real grass and that is not easily destroyed by repeated swings of a golf club striking the material, and also having a soft underpad, such that a golfer is able and is encouraged to realistically practice hitting down and through a golf ball as is to e done with an iron shot to obtain good backspin and hence, loft, and such that bounce-back or shock can be generally eliminated, and the golfer can thus practice a fluid iron stroke generally without mat-caused interruption, and having at least one follow-through notch, in part defined by a hitting area edge segment perpendicular to an intended line of flight of the golf ball to be struck by the golfer from the hitting surface, and which is trapezoidal and is additionally defined by an obliquely-angled edge segment obliquely angled to and abutting the hitting area edge segment, which envoids an area such that the golfer, when swinging an iron, can properly follow through downwardly after striking a golf ball with a golf club into the downwardmost portion of the swing when the ball is struck near the edge of the mat on the hitting area, and which allows for the golfer to follow through in a practice swing without striking the obliquely-angled edge segment, placing the golf ball in a hitting area within about three inches from a hitting area edge segment adjacent said notch, and swinging the golf club to hit the golf ball so placed.

11. The method of claim 10, wherein the golf club is an iron.

12. The method of claim 11, wherein the the hitting surface is made of a grass-like polyurethane or nylon, and the soft underpad is rubbery.

* * * * *